US005345792A

United States Patent [19]

Farrington et al.

[11] Patent Number: 5,345,792

[45] Date of Patent: Sep. 13, 1994

[54] BALANCER FOR AN AUTOMATIC WASHER

[75] Inventors: Eric K. Farrington, Lincoln Township, Berrien County; Brenner M. Sharp, St. Joseph; Victor M. Vukorpa, St. Joseph Township, Berrien County; Anthony Mason, Lincoln Township, Berrien County, all of Mich.

[73] Assignee: Whirlpool Corporation, Benton Harbor, Mich.

[21] Appl. No.: 997,435

[22] Filed: Dec. 28, 1992

[51] Int. Cl.[5] ..... D06F 37/22

[52] U.S. Cl. ..... 68/23.2; 74/573 F; 210/144

[58] Field of Search ..... 68/23.2; 74/573 F; 210/144

[56] References Cited

U.S. PATENT DOCUMENTS

| | | | |
|---|---|---|---|
| 2,525,781 | 10/1950 | De Remer | 74/573 F X |
| 2,539,533 | 1/1951 | Douglas | 68/23.2 X |
| 2,984,094 | 5/1961 | Belaieff | 68/23.2 |
| 3,089,326 | 5/1963 | Belaieff | 68/23.2 |
| 3,178,916 | 4/1965 | Belaieff et al. | 68/23.2 |
| 3,235,082 | 2/1966 | Compans | 68/23.2 X |
| 5,197,352 | 3/1993 | Haikawa | 74/573 F X |
| 5,208,931 | 5/1993 | Williams et al. | 8/159 |

FOREIGN PATENT DOCUMENTS

| | | | |
|---|---|---|---|
| 0239261 | 9/1987 | European Pat. Off. . | |
| 0361775 | 4/1990 | European Pat. Off. . | |
| 2746989 | 4/1978 | Fed. Rep. of Germany | 68/23.2 |
| 62977 | 5/1977 | Japan | 68/23.2 |
| 20739 | 5/1986 | Japan | 68/23.2 |

*Primary Examiner*—Philip R. Coe

*Attorney, Agent, or Firm*—Stephen D. Krefman; Joel M. Van Winkle; Robert O. Rice

[57] ABSTRACT

A dynamic balancer for a laundry apparatus having a rotatable drum for receiving a clothes load. The rotatable drum has a horizontal geometric axis and is rotatably supported to rotate about its horizontal geometric axis. The rotatable drum includes a generally cylindrical outer wall defining the horizontal geometric axis, a first disk and a second disk. The first disk is provided for forming a first end wall of the drum and includes a balancing means including a plurality of concentric annular chambers. The second disk is provided for forming a second end wall of the drum, opposite the first end wall, and also includes a balancing means including a plurality of concentric annular chambers. The annular concentric chambers are partially filled with fluid for balancing the rotatable drum. In operation, the rotatable drum is subject to an out-of-balance mass as a result of uneven distribution of the clothes load within the drum. The out-of-balance mass creates a spinning axis distinct from the horizontal geometric axis causing vibration during rotation. The balancing of this vibration occurs as the fluid within the chambers, under the influence of centrifugal forces occurring during unbalanced rotation, is distributed within the chambers opposite the out-of-balance mass thereby correcting for the out-of-balance mass such that the geometric horizontal axis and the spinning axis are substantially coincident.

18 Claims, 6 Drawing Sheets

FIG. 8
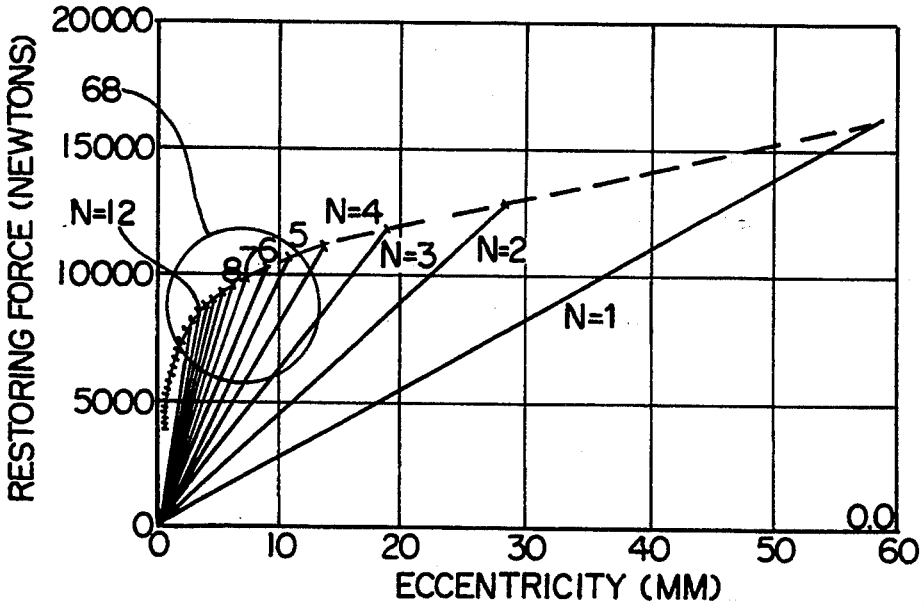
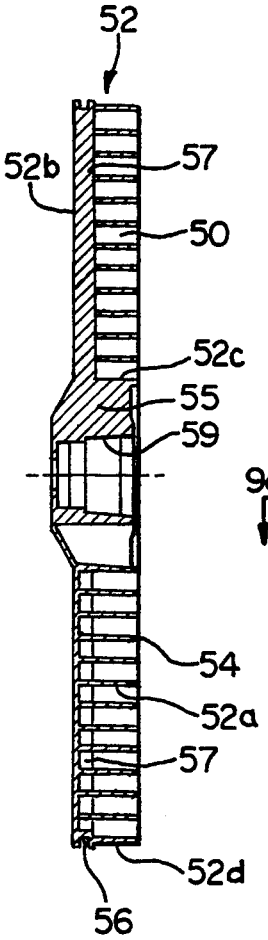
FIG. 9a
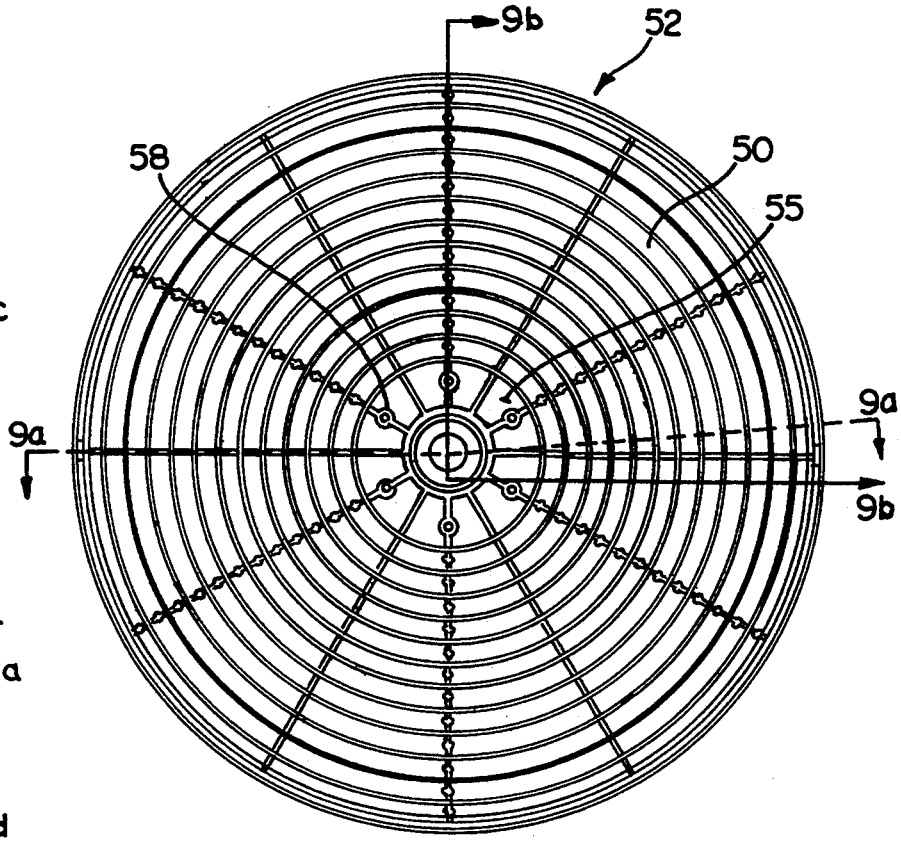
FIG. 9

BALANCER FOR AN AUTOMATIC WASHER

BACKGROUND OF THE INVENTION

1. Field of the Invention.

The present invention relates to improvement in laundry machines and more particularly, to an improved balancing device for automatically correcting unbalance in rotors such as laundering machine wash drums which are spun at high speed to centrifugally extract fluid from laundered articles.

2. Description of Prior Art.

Centrifugal extraction is a commonly used expedient in laundering machines, especially in automatic home laundering machines, for the extraction of washing fluid from laundered articles after washing or rinsing period. Typically, at the termination of a laundering operation, the laundering container or wash drum is spun at high speeds for extracting the washing fluid from the laundered articles or clothes. A relatively high spinning speed is used for centrifugal extraction of the washing fluid from the washed clothes.

Frequently, however, the relatively heavy wet clothes are disposed within the wash drum in a unbalanced fashion creating an unbalanced condition during high speed spinning. The condition of having the load out of balance creates a condition where the center of mass of the rotating wash basket (with clothes load) does not correspond to the geometric axis of the wash basket. This leads to the generation of high loads and severe vibration of the wash basket. Furthermore, the severe vibration may cause the well known phenomenon of movement of the appliance across the floor. This unbalanced condition is particularly common in a wash drum having a horizontal axis, because the clothes load is more likely to gather on one side of the basket under the influence of gravity than in vertical axis washing machines.

Therefore, it is imperative that the wash basket be balanced to prevent excessive vibration and high loads. Correction of a wash basket unbalance, however, is frequently difficult as the location of the unbalance varies for each load and for each spin cycle and the amount of unbalance changes as fluid is extracted from the clothes.

One known method to overcome the above described problem and minimize the effect of the out-of-balance condition on the spinning wash drum is to secure to the wash drum heavy counter-balance weights. These counter-balance weights, usually large blocks of concrete or cast iron, are strapped to the outside of the rotatable drum for providing a fly wheel effect such that any unbalance due to uneven distribution of the clothes will be small relative to the mass of the counter-balance weights.

Another known method for overcoming the above described balancing problems is to utilize a movable liquid balancing system. For example, U.S. Pat. No. 4,991,247 utilizes a system having a sensor for sensing an out-of-balance condition and having means for responding to the sensed out-of-balance condition by introducing liquid into a plurality of cavities disposed along the outer periphery of the wash drum such that the rotating wash drum may be balanced. Other liquid balancing systems include balancing disks wherein the liquid shifts under centrifugal force to correct the unbalance such as U.S. Pat. No. 4,044,626.

Still another known movable liquid balancing system involves utilizing a plurality of concentric balancing disks, located across the periphery of a wash basket. U.S. Pat. No 2,525,781, issued to De Remer on Oct. 17, 1950 teaches the use of three concentric balancing disks disposed around the outer periphery of a vertical axis wash basket. De Remer further teaches the relative movement of the balancing disk assemblies with regard to the rotatable wash basket. Several disadvantages, however, are present in the balancing apparatus disclosed by De Remer. Water extraction for the rotating wash basket is impeded by the balancing disks disposed around the periphery of the wash basket. Further, the inner diameter of the balancing disk assembly is restricted to be no less than the outer diameter of the rotatable wash basket, thus limiting the effective number of balancing disks utilized. These disadvantages are such that, despite the advantages provided, the balancing system disclosed by De Remer has not met with widespread commercial acceptance in the home laundry market.

Accordingly, an object of the present invention is to provide an apparatus for balancing a rotatable wash drum which is relatively more sensitive to out-of-balance conditions than the forementioned prior art.

Another object of the present invention is to provide a balancing system which does not impede water extraction from the clothes through the outer periphery of the wash drum or cause pooling of water along the outer periphery of the wash drum.

Another object of the present invention is to provide a balancing system which allows for a large opening into the drum for top loading horizontal axis washing machines.

Another object of the present invention is to provide a balancing system which maximizes the restoring force generated for any given basket out-of-balance condition.

A still further object of the present invention is to provide a balancing system utilizing a plurality of concentric fluid filled balancing disks having an optimum number of balancing disks and being configured to not exceed the outer diameter of the rotatable wash drum.

A still further object of the present invention is to provide a horizontal rotatable wash basket construction having a balancing means for the rotatable wash basket according to the above stated objectives, the balancing means further forming opposite end walls of the rotatable wash basket.

SUMMARY OF THE INVENTION

To achieve these objectives, according to the invention, there is provided a laundry apparatus having a rotatable drum for receiving a clothes load. The rotatable drum has a horizontal geometric axis and is rotatably supported to rotate about its horizontal geometric axis. The rotatable drum includes a generally cylindrical outer wall defining the horizontal geometric axis, a first disk and a second disk. The first disk is provided for forming a first end wall of the drum by having an outer edge rigidly interconnected with the cylindrical outer wall. The second disk is provided for forming a second end wall of the drum, opposite the first end wall, by having an outer edge rigidly interconnected with the cylindrical outer wall. Further, both the first disk and the second disk include a plurality of annular concentric chambers defined by a plurality of concentric walls and parallel side walls of the disks. The chambers are partially filled with fluid for balancing the rotatable drum. In operation, the rotatable drum is subject to an out-of-balance mass as a result of uneven distribution of the clothes load within the drum. The out-of-balance mass creates a spinning axis distinct from the horizontal geometric axis causing vibration during rotation. The fluid within the chambers, under the influence of centrifugal forces occurring during unbalanced rotation, is distributed within the chambers opposite the out-of-balance mass thereby partially correcting for the out-of-balance mass such that the difference between the geometric horizontal axis and the spinning axis, hereby called the eccentricity, is reduced.

Other objects of the invention may become clear to those skilled in the Art from the following description of the preferred embodiment when taken in conjunction with the following drawings.

BRIEF DESCRIPTION OF THE DRAWINGS

FIG. 8 is a graph illustrating the relationship between the restoring force of a fluid balancing system and the number of annular chambers included in a fluid balancing system of the present invention.

FIG. 9 is a detailed elevational top view of the main body of the balancing disk of FIG. 3.

FIG. 9*a* is a sectional view of the main body taken along line 9*a*—9*a* of FIG. 9.

DESCRIPTION OF PREFERRED EMBODIMENT

Figure 1:
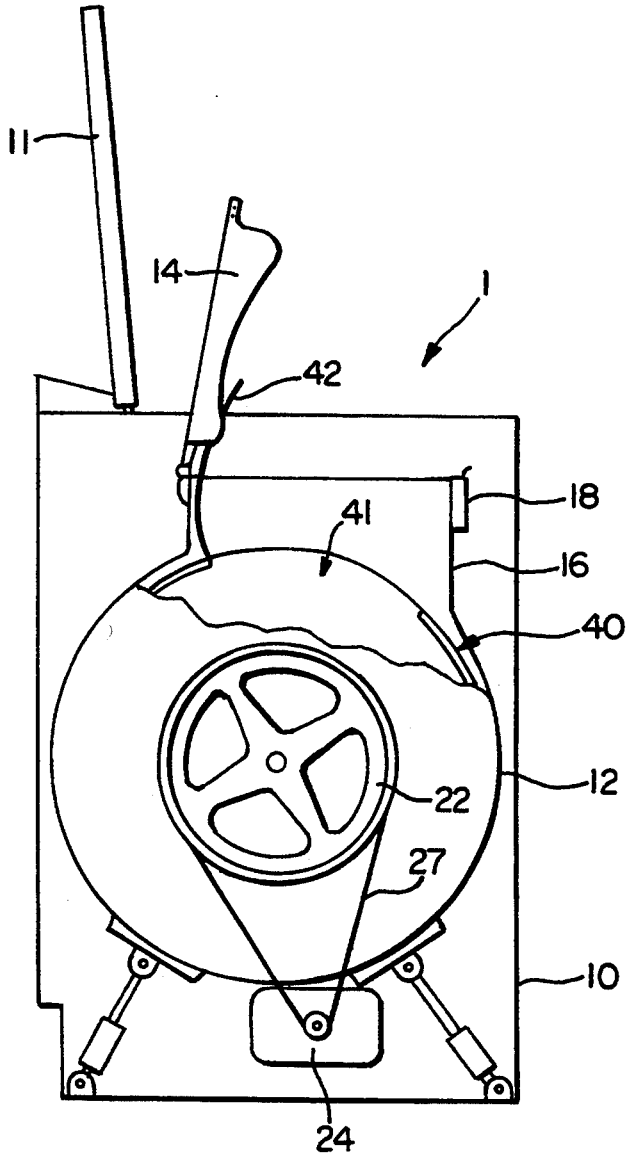
FIG. 1 is a partially cut away side view of a laundry appliance embodying the principles of the present invention.

In FIG. 1, there is illustrated a top-loading drum-type automatic washer embodying the principles of the present invention. The washer 1 has an outer cabinet 10 with an openable lid 11, shown in an open position, which encloses an imperforate wash tub 12 for receiving a supply of wash liquid. The wash tub 12 has an upwardly orientated access portion 16 and a wash tub lid 14, shown in an open position, disposed at the top of the access portion 16. A locking mechanism 18 is provided for maintaining the wash tub lid 14 in a closed and locked position during washing.

Disposed within the wash tub 12 is a rotatable, perforate wash drum 40 having an openable access door 42 for alignment with the access portion 16. The access door 42, shown in an open position, provides an opening 41 for allowing access into the wash drum 40 such that clothes may be loaded and unloaded from the wash drum 40.

Figure 2:
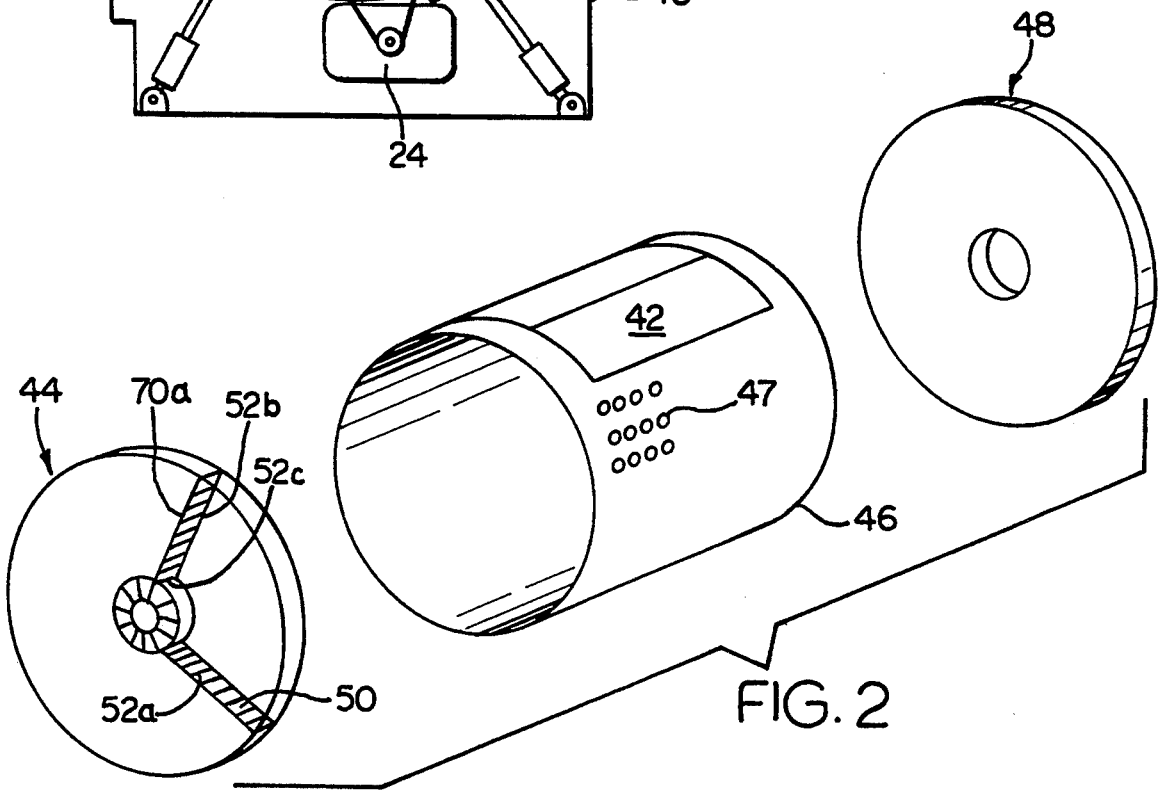
FIG. 2 is an exploded, perspective view of the rotatable drum of FIG. 1.

The general construction of the rotatable drum 40 of the present invention is shown in FIG. 2, where it can be seen that the wash drum 40 is constructed of a cylindrical outer wall member 46, a first disk or balancing disk 44 and a second disk or balancing disk 48. The cylindrical outer wall defines a horizontal longitudinal axis of the wash drum 40 and includes a plurality of perforations or holes 47. The first balancing disk 44 is rigidly interconnected with a first end of the cylindrical outerwall member 46 to form a first end wall of the wash drum 40. The second balancing disk 48 is rigidly interconnected with a second end of the cylindrical outerwall member 46, opposite the first end, to form a second end wall of the wash drum 40. This construction of the wash drum 40 allows for adequate extraction of washing liquid during wash drum 40 spinning. Further, the balancing disks 44 48, being disposed along the ends of the perforate cylindrical outerwall member 46, do not prevent or obstruct the extraction of water through the plurality of perforations 47 in the outerwall 46. Preferably, the access door 42 may be proportioned to span across substantially the entire width of the cylindrical outerwall member 46 so as to maximize access into the interior of the wash drum.

Figure 3:
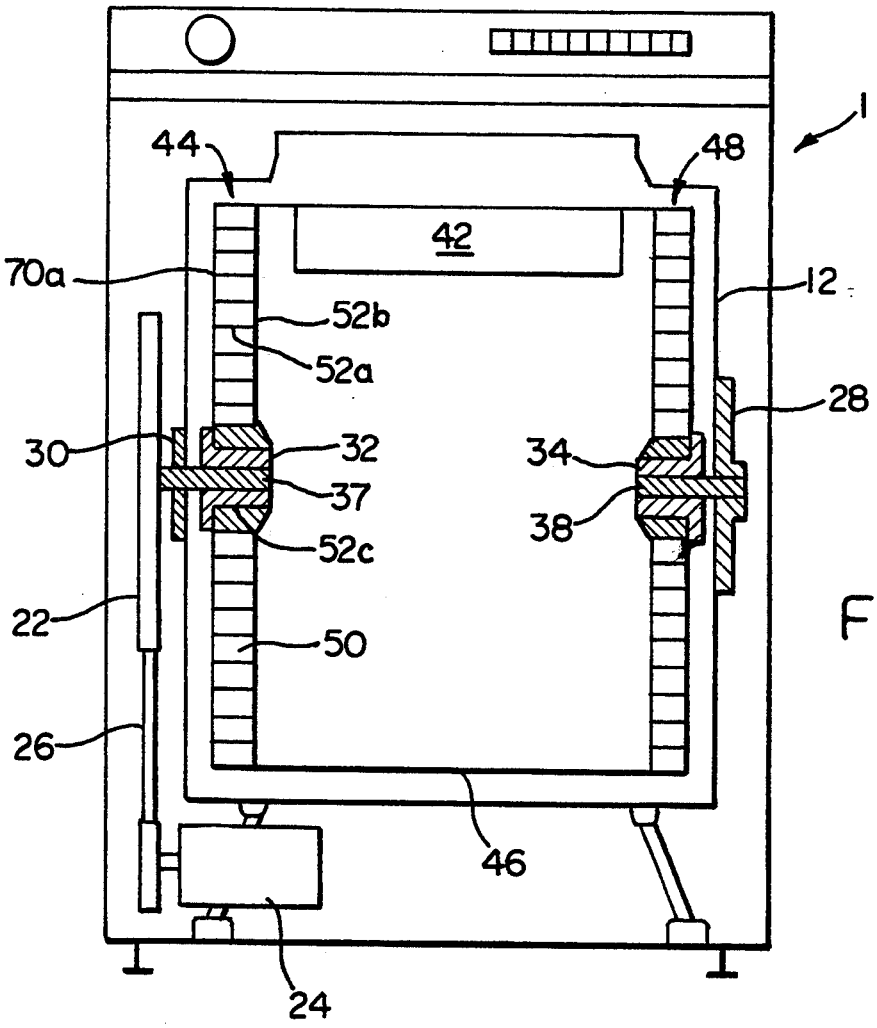
FIG. 3 is a partially cut away front view of the laundry appliance of FIG. 1.

A front view of the top loading automatic washer 1 embodying the principles of the present invention is shown in FIG. 3. A motor 24 is shown drivably connected to a pulley 22 by a belt 26. A drive shaft 37, rotatably supported by a first bearing means 30 interconnected with the wash tub 12, is provided having a first end drivingly connected to the pulley 22 and a second end drivingly connected to a first hub member 32. The first hub member 32 is rigidly connected to the first disk 44 of the rotatable wash drum 40 such that the motor 24 is drivingly interconnected with the wash drum 40. A second hub member 34, rigidly connected to the second disk 48 of the wash drum 40, is drivingly connected to a support shaft 38. The support shaft 38 is rotatable supported by a second bearing means 28 interconnected with the wash tub 12. This system, therefore, drivingly connects the motor 24 with the rotatable drum 40 and allows the drum 40 to rotate freely within the imperforate wash tub 12.

As shown in FIG. 2 and FIG. 3, the first balancing disk 44 and the second balancing disk 48 are configured to provide a plurality of annular concentric chambers 50. The annular concentric chambers 50 are defined by a plurality of annular concentric walls 52*a*, a first side wall 52*b* and a second side wall 70*a*. The chambers are further adapted to be partially filled with liquid. The balancing disks are constructed such that an innermost annular concentric wall 52*c* is disposed adjacent to the hub members 32 34. Further details of the preferred version of the balancing disk of the present invention are described further below. However, before describing details of the balancing disk construction, it is useful to discuss the action and benefits of the present balancing system.

Figure 4:
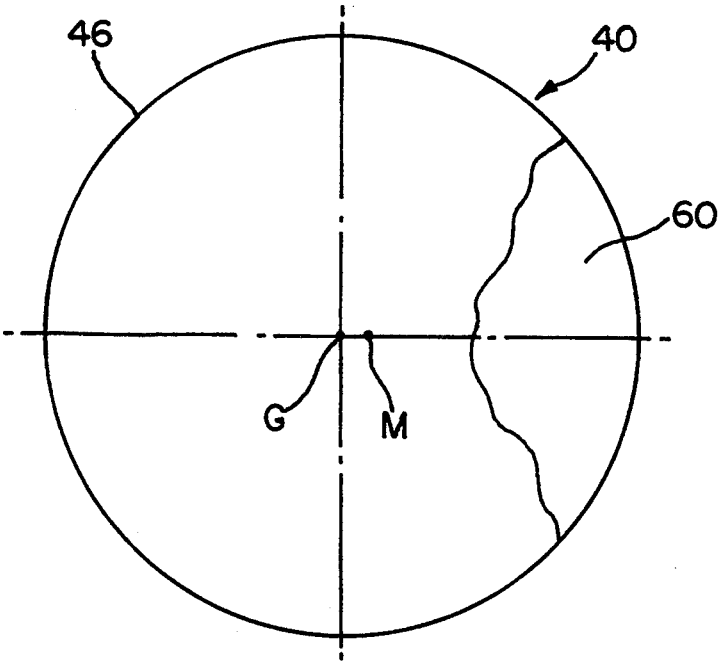
FIG. 4 is a diagrammatic view illustrating the action of a out-of-balance mass applied to the rotatable drum of the present invention.

FIGS. 4, 5, 6, 7, and 8 illustrate the action and benefits of the present invention. Referring to FIG. 4, the rotatable wash drum 40 has a geometric center G corresponding to the longitudinal axis of the wash drum 40 and is configured to have a center of mass substantially identical to its geometric center G. The hubs 32 34 (FIG. 3) align with the geometric center G such that the wash drum 40 rotates about the geometric center G in an unloaded condition. As is well-known, in a rotating body alignment of the center-of-mass and the center of rotation is necessary for smooth rotation. However, an out-of-balance mass 60, due for example to an uneven distribution of clothes, may cause the true center-of-mass of the entire rotating body, including the wash drum 40 and its contents, to shift from rotating about its geometric axis G, to a new axis of rotation or spinning axis M, the separation distance between the two described axes is called the eccentricity. This condition will cause the well-known undesired vibration, with the severity of the vibration corresponding to the magnitude of the eccentricity.

This unbalanced condition may be alleviated by the use of a plurality of fluid filled annular balancing chambers in a balancing disk. During unbalanced spinning, the fluid in the annular chambers recirculates to create an off-center fluid mass directly opposite the out-of-balance mass 60. This occurs because for speeds above the first critical frequency of the suspension system and with centrifugal accelerations higher than one gravitational acceleration, the rotating system consisting of the wash drum, the balancing disks and the out-of-balance mass, displaces in a direction 180 degrees out of phase with the unbalanced load. The fluid in the annular balancing chambers forms a free surface under the influence of centrifugal forces that is concentric with the spinning axis of the system. This action of the fluid tends to reduce the unbalance condition and can substantially align the center-of-rotation with the geometric axis G, thereby substantially reducing vibrational amplitude. It should be noted, however, that some small out-of-balance condition will always be present in this type of rotating system in the presence of an out-of-balance mass because the fluid in the annular chambers reaches an equilibrium condition of distribution opposite the out-of-balance mass at a predetermined small out-of-balance condition.

Figure 5:
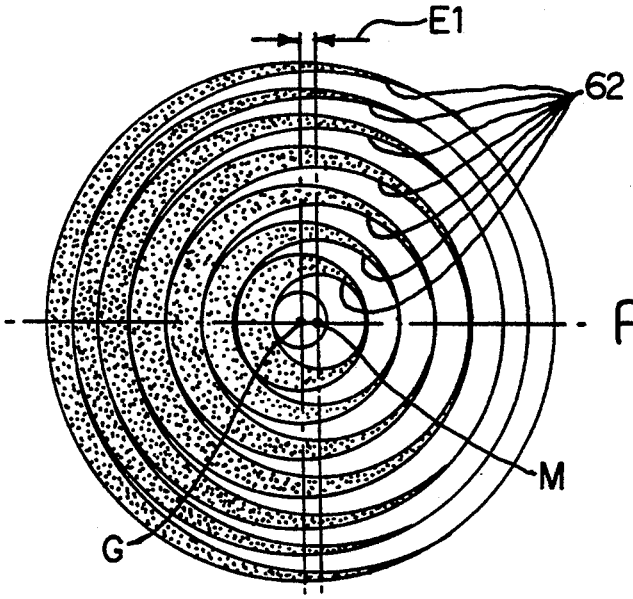
FIG. 5 is a diagrammatic view illustrating the action of a balancing disk having a plurality of fluid filled annular chambers responding to the presence of an eccentricity applied to the rotatable drum of the present invention.
Figure 6:
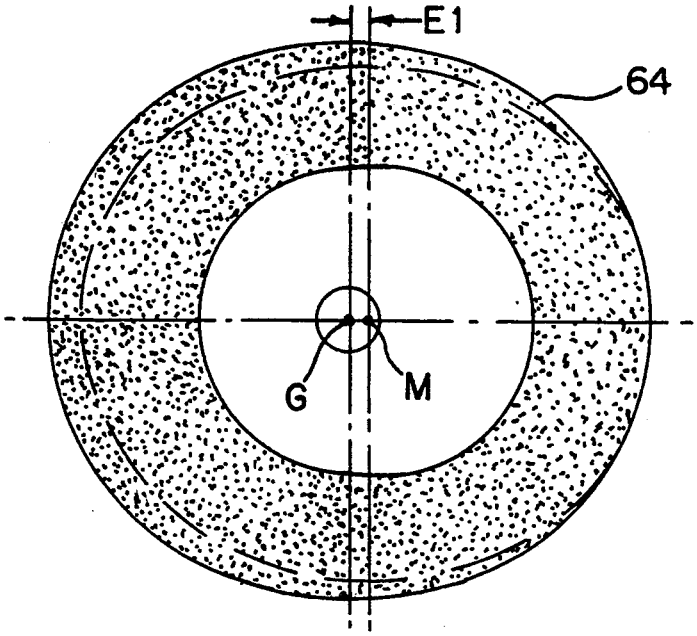
FIG. 6 is a diagrammatic view illustrating the action of a balancing disk having a single fluid filled chamber having a thickness equal to the sum of the thickness of the plurality of chambers of the balancing disk of FIG. 5 and responding to an equal eccentricity.
Figure 7:
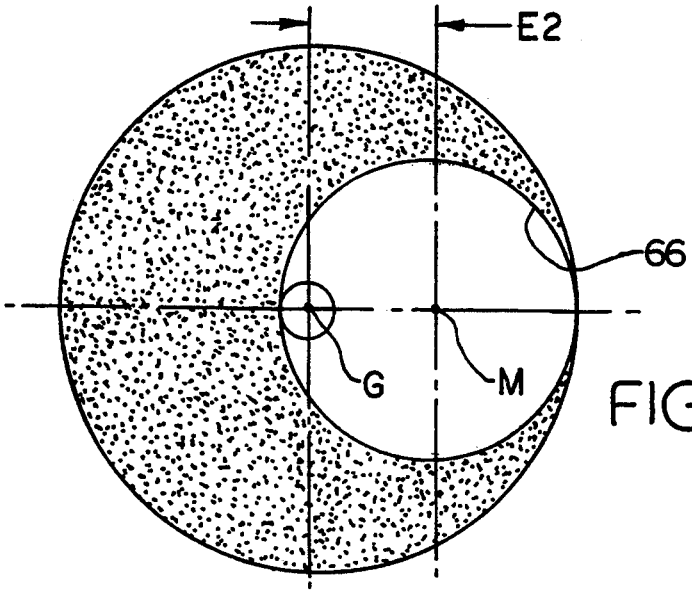
FIG. 7 is a diagrammatic view illustrating the action of the balancing disk of FIG. 6 responding to a much greater eccentricity.
Figure 9B:
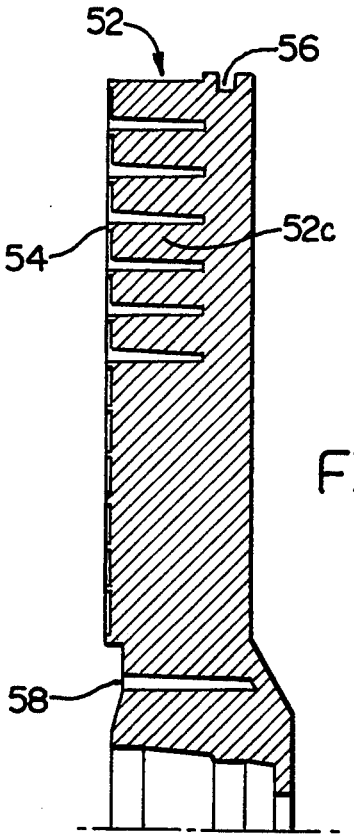
FIG. 9*b* is a sectional view of the main body taken along line 9*b*—9*b* of FIG. 9.
Figure 10A:
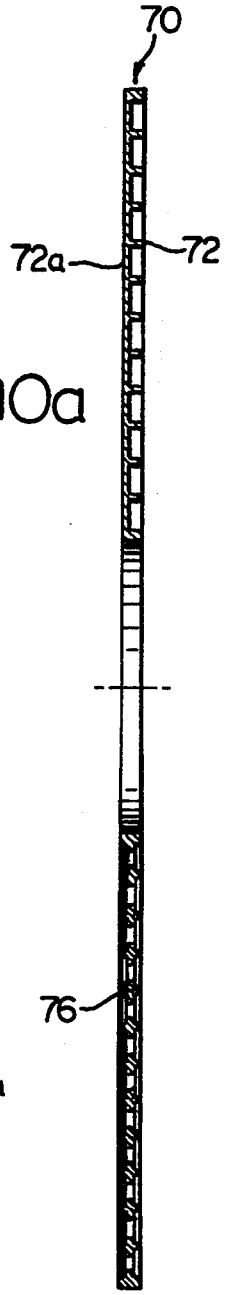
FIG. 10*a* is a sectional view of the cover taken along line 10*a*—10*a* of FIG. 10.
Figure 10:
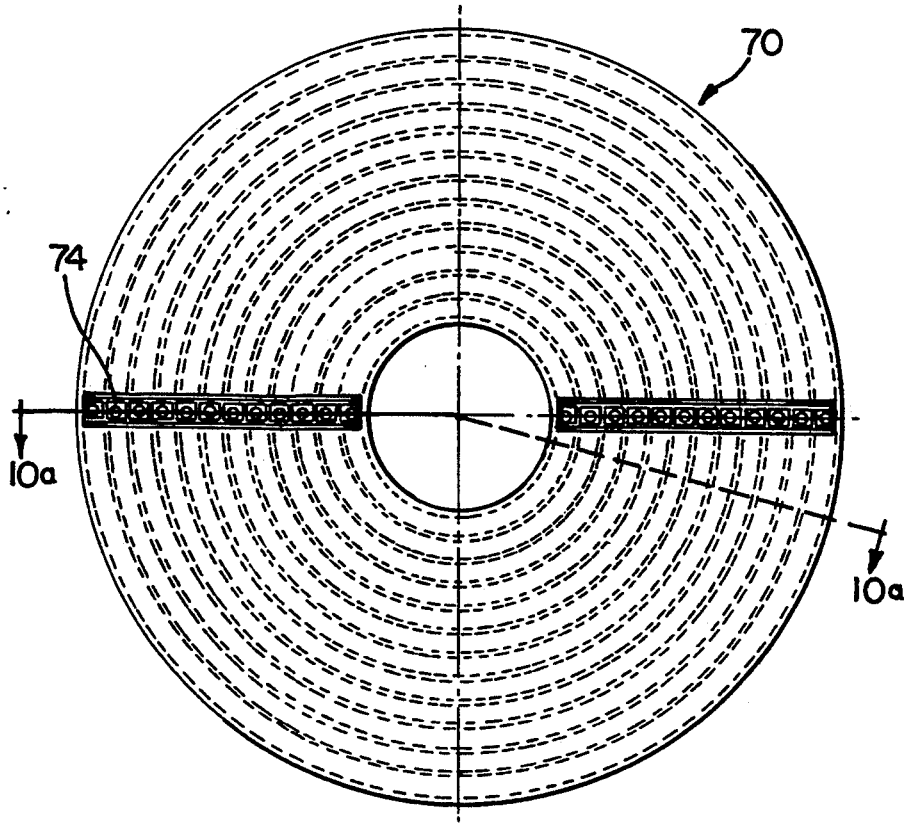
FIG. 10 is a detailed elevational view of the cover of the balancing disk of FIG. 3.

FIGS. 5, 6 and 7 may be used to illustrate the most effective configuration of a liquid balancing system and may help explain the increase in efficiency of liquid balancing action due to deliberate limitations of balancing chamber thickness and use of a plurality of chambers to obtain the necessary amount of corrective liquid mass. In FIG. 5 there is shown a balancing disk having a plurality of fluid-filled annular balancing chambers acting under the influence of an eccentricity E1, wherein the size of E1 is proportional to the vibrational amplitude created by the out-of-balance mass. The most effective correction action in the balancing disk takes place when the greatest relative shift of liquid in the balancing chambers occurs in response to an out-of-balance mass such that a maximum restoring force is provided. This occurs when the fluid in the balancing chambers has formed free surfaces concentric with the spinning axis M and have surfaces 62 tangent to the inner surface of the chambers and therefore are providing substantially the maximum restoring force to balance the rotary wash drum 40.

FIG. 6 shows a balancing disk having a single fluid filled balancing chamber having a substantially equal amount of fluid as the balancing disk shown in FIG. 5. In FIG. 6, the fluid is also acting under an out-of-balance mass creating the eccentricity E1 and has formed a free surface concentric with the spinning axis. It can be seen, however, that the fluid positioned inside the dotted line 64 forms a concentric ring around the center of rotation and does not constitute a counter-balancing effect. Only the liquid positioned outside the dotted line 64 contributes a restoring force to correct the unbalanced condition. As it is readily seen, the restoring force, contributed by the fluid outside the dotted line 64, is significantly less than the restoring force contributed by the fluid in the balancing disks shown in FIG. 5. It is therefore evident, that for relatively small eccentricities, a single chamber balancing system having a relatively thick fluid filled balancing chamber does not provide effective corrective action at small vibrational amplitudes.

For a balancing disk having a single fluid filled chamber to contribute a substantially equal restoring force as a balancing disk having a plurality of annular fluid filled balancing chambers, a much greater eccentricity must occur. FIG. 7 shows a single balancing chamber contributing a substantially equal restoring force as the plurality of chambers shown in FIG. 5. In the single chamber construction as shown in FIG. 7, a relatively large eccentricity E2 must occur to cause the fluid in the single chamber to form a surface 66 tangent to the inner surface of the chamber. The vibrational amplitude corresponding to the relatively large eccentricity E2 would be relatively large and undesirable when compared to the vibrational amplitude corresponding to E1. In contrast, in the balancing system having a plurality of chambers as shown in FIG. 5, the relatively small eccentricity E1, caused the optimum fluid position for balancing thereby maintaining vibration amplitude of the rotating system at a preferred minimal level.

The benefit and increase in efficiency of liquid balancing action due to deliberate limitation of chamber thickness and use of a plurality of chambers is further illustrated in Fig. 8. Each chamber within a balancing disk substantially improves the effectiveness of the balancing disk where effectiveness is defined as the restoring force provided by the fluid in the chambers divided by the eccentricity present. However, assuming the outer radius and thickness of the disk remain the same, the improvement in effectiveness which occurs with each additional chamber is reduced by two factors. The first factor is that as the number of chambers rises because each additional chamber is added at a smaller radius such that less fluid is disposed in each additional chamber. The second factor is that the wall thickness between the chambers negatively impacts the effectiveness of the balancing disks as the number of chambers increases, because the wall thickness reduces the overall amount of fluid in the balancing disk.

In FIG. 8, these factors are taken into account and a typical plot of balancing disk effectiveness is shown where the ordinate represents the eccentricity caused by an out-of-balance mass and the abscissa represents the restoring force provided by the balancing disk system. As described above, it is preferable to obtain a maximum restoring force for a minimum eccentricity to minimize the vibrational amplitude of the rotating body. A plurality of plots are provide for various fluid filled balancing disks having a different number of chambers N. It can be seen that for a balancing disk having one chamber (N=1), an eccentricity of 35 mm is required prior to a restoring force of approximately 10000 Newtons. However, for a balancing system design having 8 chambers, an eccentricity of only 7 mm is required for this same restoring force of 10000 Newtons. Further, for a balancing system having 12 chambers, an eccentricity of only 4 mm provides a 8500 Newton restoring force. It is clear that for a typical balancing disk system there exists an optimum number of chambers as determined by a knee 68 in the plot which defines general point of diminishing returns beyond which the maximum restoring force achieved is significantly reduced. An optimum number of chambers can therefore by determined by selecting a number in the region of the knee 68 of the plot.

Looking now at FIG. 9, FIG. 9*a*, FIG. 9*b*, FIG. 10, FIG. 10*a*, FIG. 11 and FIG. 11*a*, the details of the balancing disks 44 48 are further illustrated. In a preferred configuration, the balancing disks 44 48 include a main body 52, shown in FIG. 9, 9*a* and 9*b*, and a cover 70, shown in FIG. 10 and 10*a*.

The main body 52 is an integral member and includes the plurality of annular concentric walls 52*a* having end points 54 and the first side wall 52*b*. The main body further includes the innermost annular concentric wall 52*c* and an outermost annular concentric wall 52*d*. Furthermore, a plurality of baffle walls 52*e* are provided for modifying the flow of fluid within the concentric chambers 50 such that violent fluid flow within the balancing disk is prevented. An annular channel 56 disposed on the outermost annular wall 52*d* is provided for providing means for interconnecting the outerwall 46 with the main body 52 as further described below. An annular portion 55 is disposed between the innermost annular wall 52*c* and an annular hub positioning wall 59. Disposed within the annular portion 55 are a plurality of axially extending bosses 58 for interconnecting the main body 52 with the hub members 34 36 as further described below.

The cover 70 is an integral member and includes the second side wall 70*a* and a plurality of annular weld pads 74 corresponding to the end point 54 of the annular walls 52*a*. A plurality of fill holes 74 are provided in the cover. During assembly of the balancing disk 44, the weld pads 74 of the cover and the end points 54 of the main body are independently heated and then forcibly pressed together such that the main body 52 and the cover 70 are sealably welded together. The interconnected main body 52 and cover 70 comprise the balancing disks 44 48 and create the concentric annular chambers 50. These chambers may then be filled with balancing fluid though the fill holes 74 provided in the cover 70. A plurality of ribs 76 surround the fill holes 74.

Figure 11:
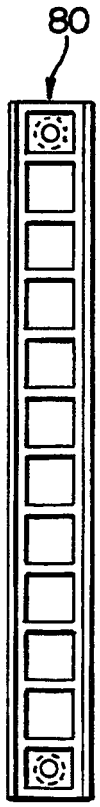
FIG. 11 is an elevational top view of the plug strip of the balancing disk of FIG. 3.
Figure 11A:
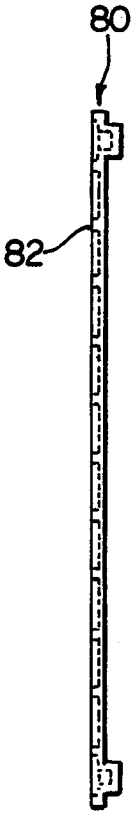
FIG. 11*a* is an elevational side view of the plug strip of the balancing disk of FIG. 3.

FIG. 11 and 11a show a plug strip 80 for sealably plugging the holes in the cover 70. The plug strip includes a plurality of ribs 82 corresponding to the ribs 76 disposed in the cover 70. During assembly of the plug strip 80 and the cover 70, the ribs 76 of the cover and the ribs 82 of the plug strip are independently heated and then forcibly urged together such that the cover and the plug strip 80 are sealably welded together after the chambers have had an adequate amount of fluid added and a leak test has been performed.

Figure 12:
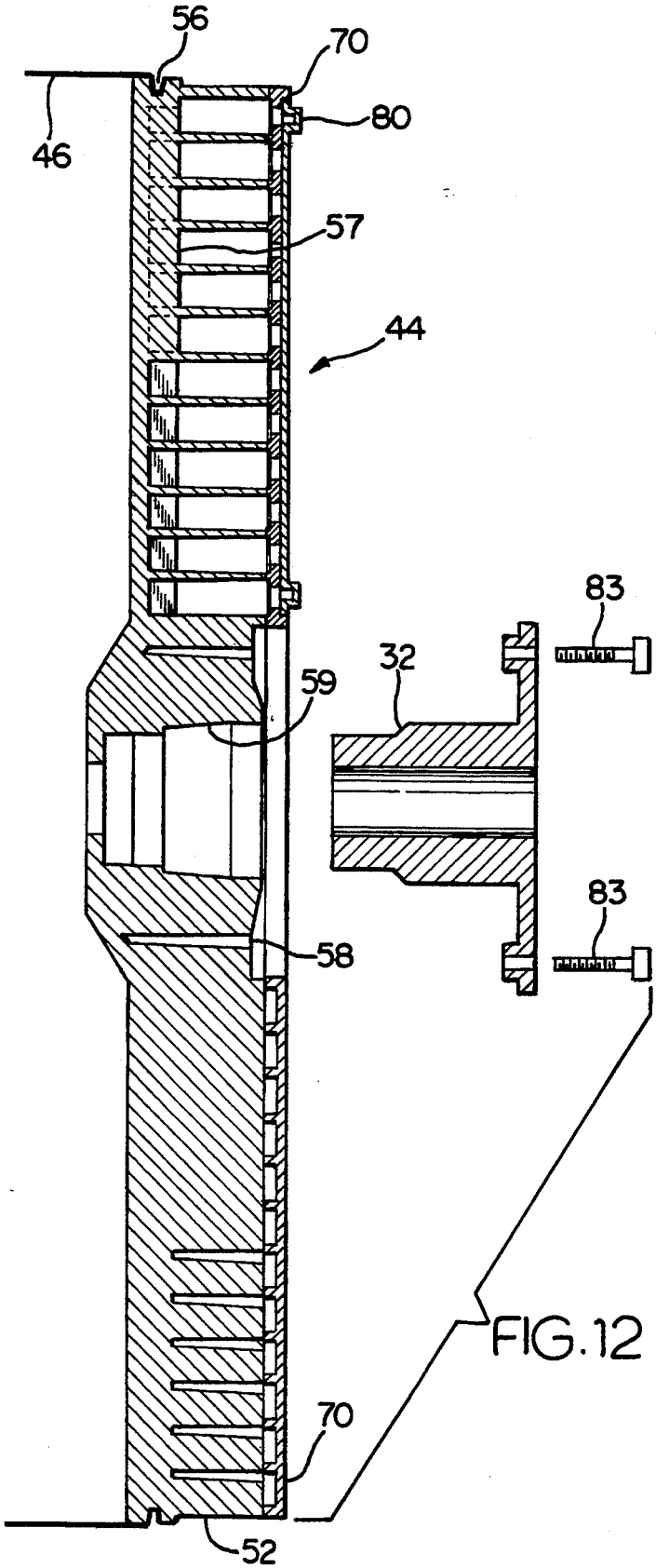
FIG. 12 is a detailed sectional view of the interconnection between the cylindrical outerwall and balancing disk of FIG. 3.

The assembled first balancing disk 44, including both the main body 52 and the cover 70, may then be interconnected with the cylindrical outerwall 46 and the hub members 32 34. As shown in FIG. 12, the annular channel 56 on the main body 52 is provided for fastening the cylindrical outerwall 46 securely to the balancing disk 44 wherein the outerwall 46 is forcibly urged into the channel 56 and locked in place. A plurality of radial ribs 57 are provided on the main body 52 for strengthening the main body such that support is providing during the operation of urging the outerwall 46 into the channel 56. The hub member 32 34 may be press fit into the opening defined by the annular hub positioning wall 59 of the main body 52. In addition, a plurality of screws 83 for securely fastening the hub members 32 34 to the balancing disks 44 48*a* are provided for insertion into the plurality of bosses 58 on the main body 52. As mentioned above, the hub members 32 34 receive and drivingly interconnect with the drive shaft 37 and the support shaft 38.

The above described configuration of a wash drum, therefore, provides a novel structure for providing balancing means to counteract an unbalanced mass in the wash drum. No balancing rings or mass are required to be disposed around the periphery of the wash drum. Therefore, wash liquid extraction may be readily achieved through the perforate cylindrical outerwall and further, the access door for the wash drum may have a preferable size and location. Additionally, the above described balancing system utilizes a balancing disk having an optimum number of concentric fluid filled chambers for balancing the wash drum. Finally, the above described disk construction is relatively cost effective and minimizes the total mass required for balancing the wash drum.

Although the present invention has been described with reference to a specific embodiment, those of skill in the Art will recognize that changes may be made thereto without departing from the scope and spirit of the invention as set forth in the appended claims.

We claim:

1. A laundry apparatus having a rotatable drum for receiving a clothes load, said rotatable drum being capable of being subject to an out-of-balance mass wherein said out-of-balance mass may create a spinning axis distinct from said horizontal geometric axis, said rotatable drum further comprising:

a generally cylindrical outerwall defining a horizontal axis and having a predetermined diameter and a first end and a second end;

a first disk for forming a first end wall of said rotatable drum and having an outer edge rigidly interconnected with said first end of said generally cylindrical outerwall, said first disk further including:

a plurality of annular chambers, said plurality of annular chambers being concentric, each of said annular chambers being defined by concentric annular inner and outer walls and substantially parallel side walls, said plurality of annular chambers having an innermost chamber having an annular inner wall, each chamber further being adapted to be partially filled with liquid;

a second disk for forming a second end wall of said rotatable drum and having an outer edge rigidly interconnected with said second end of said generally cylindrical outerwall;

a motor for rotatable driving said rotatable drum;

a rotatably supported drive shaft drivingly interconnected with said motor;

a hub drivingly interconnected with said drive shaft, said hub having an outer surface; and said annular inner wall of said innermost chamber of said first disk being disposed around said outer surface of said hub wherein said first disk is drivingly interconnected with said hub for rotatably driving said rotatable drum.

2. A laundry apparatus according to claim 1, wherein said generally cylindrical outerwall is perforate such as to allow extraction of wash liquid during centrifuging.

3. A laundry apparatus according to claim 1, wherein said rotatable drum is disposed within a cabinet, said cabinet having an openable lid on a top surface for accessing said rotatable drum, and said generally cylindrical outerwall further comprises:

an opening for alignment with said openable lid, said opening further including an access door for closing said opening and being openable for allowing access into said rotatable drum.

4. A laundry apparatus according to claim 1 wherein said plurality of annual chambers comprise at least five annular chambers.

5. A laundry apparatus according to claims 1 further comprising:

an annular portion extending between said annular inner wall and said hub for interconnecting said annular inner wall and said hub.

6. A laundry apparatus having a rotatable drum for receiving a clothes load, said rotatable drum further comprising:

a generally cylindrical outerwall defining a horizontal axis and having a predetermined diameter and a first end and a second end;

a first disk for forming a first end wall of said rotatable drum and having an outer edge rigidly interconnected with said first end of said generally cylindrical outerwall, said first disk further including a first balancing means for balancing said out-of-balance mass; and a second disk for forming a second end wall of said rotatable drum and having an outer edge rigidly interconnected with said second end of said generally cylindrical outerwall, said second disk further including:

a plurality of annular chambers, said plurality of annular chambers being concentric, each of said annular chambers being defined by concentric annular inner and outer walls and substantially parallel side walls, said plurality of annular chambers having an innermost chamber having an annular inner wall, each chamber further being adapted to be partially filled with liquid;

a hub having and annular outer wall, said annular inner wall of said innermost chamber of said second disk being disposed around said annular outer wall of said hub wherein said hub and said second disk are rigidly interconnected; and a rotatably supported support shaft for rotatably supporting said rotatable drum, said rotatably supported support shaft being drivingly interconnected with said hub.

7. A laundry apparatus according to claim 6 wherein said plurality of annular chambers comprise at least five annular chambers.

8. A laundry apparatus according to claims 6 further comprising:

an annular portion extending between said annular inner wall and said hub for interconnecting said annular inner wall and said hub.

9. A laundry apparatus having a rotatable cylindrical basket capable of being subject to an out-of-balance condition, said rotatable cylindrical basket comprising:

a generally cylindrical outerwall defining a horizontal axis and having a predetermined diameter and a first end and a second end;

a first end wall interconnected with said first end of said generally cylindrical outerwall;

a second end wall interconnected with said second end of said generally cylindrical outerwall;

said first end wall and said second end wall including:

an integral main body including a side wall and a plurality of annular concentric walls extending substantially perpendicular from said side wall, each of said annular concentric walls having an end point, said main body having an outer periphery interconnected with said generally cylindrical outerwall such that said main body is oriented substantially perpendicular to the axis of rotation, said main body further having a center point substantially coincident with the axis of rotation of said generally cylindrical outerwall; and a cover for sealably interconnecting with said main body for forming a plurality of annular chambers, each chamber further being adapted to be partially filed with liquid, said cover having a plurality of holes such that at least one hole corresponds to each annular chamber, said cover further having a plurality of weld pads corresponding to said annular concentric walls of said integral main body such that said annular weld pads and said end points of said annular concentric walls may be independently heated and forcibly urged together, thereby sealably interconnecting said cover with said integral main body.

10. A rotatable cylindrical basket according to claim 9 wherein said main body further comprises:

means for securely interconnecting said main body with said generally cylindrical outerwall.

11. An automatic washer having a rotatable drum for receiving a clothes load, said rotatable drum having a horizontal geometric axis and further being subject to an out-of-balance mass, said out-of-balance mass creating a spinning axis distinct from said horizontal geometric axis, said rotatable drum being disposed within a cabinet, said cabinet having an openable lid on a top surface for accessing said rotatable drum, said rotatable drum further comprising:

a generally cylindrical outerwall defining a horizontal axis and having a predetermined diameter and a first end and a second end, said generally cylindrical outerwall further having an opening for alignment with said openable lid, said opening further having an access door for closing said opening and being openable for allowing access into said generally cylindrical outerwall;

a first balancing disk for forming a first end wall of said rotatable drum and having an outer edge rigidly interconnected with said first end of said generally cylindrical outerwall, said first balancing disk further comprising:

an integral main body including a first side wall and a plurality of annular concentric walls extending substantially perpendicular from said first side wall, each of said annular concentric walls having an end point, said main body being interconnected with said rotating body such that said main body is oriented substantially perpendicular to the axis of rotation, said main body further having a center point substantially coincident with the axis of rotation;

an integral cover including a second annular side wall and a plurality of annular weld pads corresponding to said annular concentric walls of said integral main body such that said annular weld pads and said end points of said annular concentric walls may be independently heated and forcibly urged together for sealably welding said integral cover to said integral main body;

said integral main body and said integral cover forming a plurality of annular chambers, said plurality of annular chambers being concentric, each of said annular chambers being defined by said annular concentric walls, said first side wall and said second annular side wall, said plurality of annular chambers having an innermost chamber having an annular inner wall, said annular inner wall of said innermost chamber having an inner diameter less than said predetermined diameter of said generally cylindrical outerwall, each chamber further being adapted to be partially filled with liquid such that said liquid in said plurality of chambers forms a free surface under the influence of centrifugal force that is concentric with said spinning axis and distributes more liquid opposite said out-of-balance mass thereby correcting for said out-of-balance mass such that said geometric horizontal axis and said spinning axis are substantially coincident;

a second balancing disk for forming a second end wall of said rotatable drum and having an outer edge rigidly interconnected with said second end of said generally cylindrical outerwall, said second balancing disk further being substantially identical to said first balancing disk.

12. An automatic washer according to claim 11 further comprising:

a motor for rotatably driving said rotatable drum;

a hub means;

means for interconnecting said hub means with said main body; and means for drivingly interconnecting said motor with said hub means.

13. An automatic washer according to claim 11 wherein said main body further comprises:

a means for interconnecting said main body with said generally cylindrical outerwall.

14. A laundry apparatus having a rotatable drum for receiving a clothes load, said rotatable drum comprising:

a generally cylindrical outerwall defining a horizontal axis and having a predetermined diameter and a first end and a second end;

a first disk for forming a first end wall of said rotatable drum and having an outer edge rigidly interconnected with said first end of said generally cylindrical outerwall, said first disk further including at least five annular concentric chambers partially filled with fluid for balancing said out-of-balance mass, said at least five annular chambers having an innermost chamber having a first annular inner wall; and a second disk for forming a second end wall of said rotatable drum opposite of said first wall and having an outer edge rigidly interconnected with said second end of said generally cylindrical outerwall, said second disk further including at least five annular concentric chambers partially filled with fluid for balancing said out-of-balance mass, said at least five annular chambers having an innermost chamber having a second annular inner wall.

15. A laundry apparatus according to claim 14 further comprising:

a motor for rotatable driving said rotatable drum;

a rotatably supported drive shaft drivingly interconnected with said motor;

a first hub drivingly interconnected with said drive shaft, said first hub means having an outer surface; and said first annular inner wall of said first disk being disposed around said outer surface of said first hub wherein said first disk is drivingly interconnected with said first hub for rotatably driving said rotatable drum.

16. A laundry apparatus according to claim 15 further comprising:

a second hub having and annular outer wall, said second annular inner wall of said second disk being disposed around said annular outer wall of said second hub wherein said second hub and said second disk are rigidly interconnected; and a rotatably supported support shaft for rotatably supporting said rotatable drum, said rotatably supported support shaft being drivingly interconnected with said second hub.

17. A laundry apparatus according to claim 16 further comprising:

a first annular portion extending between said first annular inner wall and said first hub for interconnecting said first annular inner wall and said first hub; and a second annular portion extending between said second annular inner wall and said second hub for interconnecting said second annular inner wall and said second hub.

18. A laundry apparatus according to claim 14 wherein said first disk and said second disk further comprise:

an integral main body including a first side wall and a plurality of annular concentric walls extending substantially perpendicular from said first side wall, each of said annular concentric walls having an end point, said main body having an outer periphery interconnected with said generally cylindrical outerwall such that said main body is oriented substantially perpendicular to the axis of rotation, said main body further having a center point substantially coincident with the axis of rotation of said generally cylindrical outerwall; and a cover for sealably interconnecting with said integral main body such that said at least five annular chambers are formed.

* * * * *